US007593674B2

(12) United States Patent
Matsumoto et al.

(10) Patent No.: US 7,593,674 B2
(45) Date of Patent: Sep. 22, 2009

(54) BODY MEMBER OF A POWDER CONTAINER

(75) Inventors: Junichi Matsumoto, Kanagawa (JP); Nobuo Kasahara, Kanagawa (JP); Nobuo Iwata, Kanagawa (JP); Satoshi Muramatsu, Tokyo (JP); Goro Katsuyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/738,332

(22) Filed: Apr. 20, 2007

(65) Prior Publication Data

US 2007/0189813 A1 Aug. 16, 2007

Related U.S. Application Data

(63) Continuation of application No. 10/666,250, filed on Sep. 22, 2003, now Pat. No. 7,221,891.

(30) Foreign Application Priority Data

Sep. 20, 2002 (JP) ..... 2002-275690
Feb. 5, 2003 (JP) ..... 2003-028708

(51) Int. Cl.
*G03G 15/08* (2006.01)

(52) U.S. Cl. ..... 399/262

(58) Field of Classification Search ..... 399/262, 399/265, 119, 238, 258; 141/68, 130, 291, 141/315, 346; 383/42, 44, 121; 206/525; 222/DIG. 1

See application file for complete search history.

(56) References Cited

U.S. PATENT DOCUMENTS 5,386,274 A 1/1995 Sanpe et al.
5,462,101 A 10/1995 Mouchmouchian
5,594,535 A 1/1997 Beaufort et al.
5,663,788 A 9/1997 Sanpe
5,828,935 A 10/1998 Tatsumi et al.
6,126,315 A 10/2000 Ichikawa et al.
6,311,745 B1 11/2001 Welch et al.
6,381,435 B2 4/2002 Shinohara et al.
6,507,720 B2 1/2003 Kabumoto et al.
6,519,436 B2 2/2003 Katsuyama
6,526,246 B2 2/2003 Iwata et al.

(Continued)

FOREIGN PATENT DOCUMENTS

CN 1152138 6/1997

(Continued)

OTHER PUBLICATIONS

U.S. Appl. No. 11/871,516, filed Oct. 12, 2007, Kasahara et al.

*Primary Examiner*—Robert Beatty
(74) *Attorney, Agent, or Firm*—Oblon, Spivak, McClelland, Maier & Neustadt, P.C.

(57) ABSTRACT

The body member of a powder container of the present invention includes a bag-like powder storing body storing powder and formed with an opening at one end, and a base member affixed to the opening of the powder storing body. The base member allows an outlet member, which is formed with a passage configured to deliver the powder from the powder storing body to an outlet and has a shutter function for selectively blocking or unblocking the passage, to be connected to or disconnected from the base member.

32 Claims, 17 Drawing Sheets

U.S. PATENT DOCUMENTS

| | | | | |
|---|---|---|---|---|
| 6,532,352 | B2 | 3/2003 | Katsuyama | |
| 6,542,707 | B2 | 4/2003 | Muramatsu et al. | |
| 6,549,744 | B2 | 4/2003 | Terazawa et al. | |
| 6,567,637 | B2 | 5/2003 | Yanagisawa et al. | |
| 6,571,076 | B2 | 5/2003 | Kasahara et al. | |
| 6,597,883 | B2 | 7/2003 | Muramatsu et al. | |
| 6,628,908 | B2 | 9/2003 | Matsumoto et al. | |
| 6,628,913 | B2 | 9/2003 | Matsumoto et al. | |
| 6,628,915 | B2 | 9/2003 | Muramatsu et al. | |
| 6,647,236 | B2 | 11/2003 | Katsuyama | |
| 6,648,218 | B2 | 11/2003 | Katsuyama et al. | |
| 6,690,901 | B2 | 2/2004 | Katsuyama et al. | |
| 6,871,034 | B2 | 3/2005 | Muramatsu et al. | |
| 6,882,817 | B2 | 4/2005 | Kita | |
| 7,085,522 | B2 | 8/2006 | Muramatsu et al. | |
| 7,133,629 | B2 | 11/2006 | Kita | |
| 7,184,691 | B2 | 2/2007 | Kita et al. | |
| 7,221,891 | B2 * | 5/2007 | Matsumoto et al. | ..... 399/262 |
| 7,248,824 | B2 | 7/2007 | Takami | |
| 7,257,348 | B2 | 8/2007 | Matsumoto et al. | |
| 7,277,664 | B2 | 10/2007 | Katsuyama et al. | |
| 2001/0017998 | A1 | 8/2001 | Terazawa et al. | |
| 2001/0052526 | A1 | 12/2001 | Kasahara et al. | |
| 2003/0036909 | A1 | 2/2003 | Kato | |
| 2003/0081969 | A1 | 5/2003 | Muramatsu et al. | |
| 2003/0215267 | A1 | 11/2003 | Kita | |
| 2004/0011425 | A1 | 1/2004 | Wegman et al. | |
| 2004/0131392 | A1 | 7/2004 | Matsumoto et al. | |
| 2005/0117936 | A1 | 6/2005 | Takami | |
| 2005/0226655 | A1 | 10/2005 | Kaysuyama et al. | |
| 2006/0002743 | A1 | 1/2006 | Katsuyama et al. | |
| 2006/0099012 | A1 | 5/2006 | Kita et al. | |
| 2007/0122204 | A1 | 5/2007 | Kita | |

FOREIGN PATENT DOCUMENTS

| | | |
|---|---|---|
| EP | 1 229 402 | 8/2002 |
| JP | 10-274877 | 10/1998 |
| JP | 10274877 | 10/1998 |
| JP | 2000-356898 | 12/2000 |
| JP | 2001-305943 | 11/2001 |
| JP | 2002-002833 | 1/2002 |
| JP | 2002-302169 | 10/2002 |
| WO | WO 2004/027522 | 4/2004 |

* cited by examiner

BODY MEMBER OF A POWDER CONTAINER

BACKGROUND OF THE INVENTION

1. Field of the Invention

The present invention relates to a copier, facsimile apparatus, printer or similar image forming apparatus and more particularly to the body member of a powder container for storing toner or similar powder for used in the image forming apparatus.

2. Description of the Background Art

It is a common practice with an image forming apparatus to use two-component type developer, i.e., a toner and carrier mixture for developing a latent image formed on an image carrier. The toner of the developer is consumed by repeated image formation, so that fresh toner must be replenished to a developing device in accordance with the consumption, as needed. For the replenishment of fresh toner, use is made of a toner bottle, toner cartridge or similar toner container storing fresh toner.

Japanese Patent Laid-Open Publication Nos. 2001-31585, 2001-324863 and 2002-72649, for example, each disclose a particular toner container including a bag-like toner storing body formed with an opening at one end. A mouth member or toner outlet member is affixed to the opening of the toner storing body for delivering toner stored in the toner storing body. The outlet of the toner outlet member is provided with a self-closing valve implemented by a seal member, which is formed of sponge or similar elastic material and formed with a cruciform slit at the center. The toner container can be set at the mount portion of an image forming apparatus only if dropped toward the mount portion from the above. When the toner container is so dropped, a nozzle is inserted into the slit of the seal member for thereby opening the slit. When the toner container is removed from the mount portion, the slit is automatically closed due to the elasticity of the seal member.

However, the restoring force of the elastic seal member is apt to decrease due to, e.g., the hardening of the seal member or creep deformation ascribable to aging. When the restoring force decreases, it is likely that toner leaks and is scattered around during the interval between the time when the toner container is removed from the mount portion and the time when the slit of the seal member closes.

On the other hand, it is desirable from the resource saving standpoint to recycle the constituent parts of the toner container without discarding them. The problem with the conventional toner container is that the elastic seal member is affixed to the body portion of the mouth member by adhesive. Therefore, to recycle the constituent parts of the toner container, it is necessary to remove the seal member from the mouth member by troublesome operation. This is also true with any other powder container storing powder other than toner.

Technologies relating to the present invention are also disclosed in, e.g., Japanese Patent Laid-Open Publication Nos. 2000-356898, 2001-305843 and 2002-302169.

SUMMARY OF THE INVENTION

It is an object of the present invention to provide the body member of a powder container capable of being easily recycled when combined with an outlet member having a shutter function.

The body member of a powder container of the present invention includes a bag-like powder storing body storing powder and formed with an opening at one end, and a base member affixed to the opening of the powder storing body.

The base member allows an outlet member, which is formed with a passage configured to deliver the powder from the powder storing body to an outlet and has a shutter function for selectively blocking or unblocking the passage, to be connected to or disconnected from the base member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
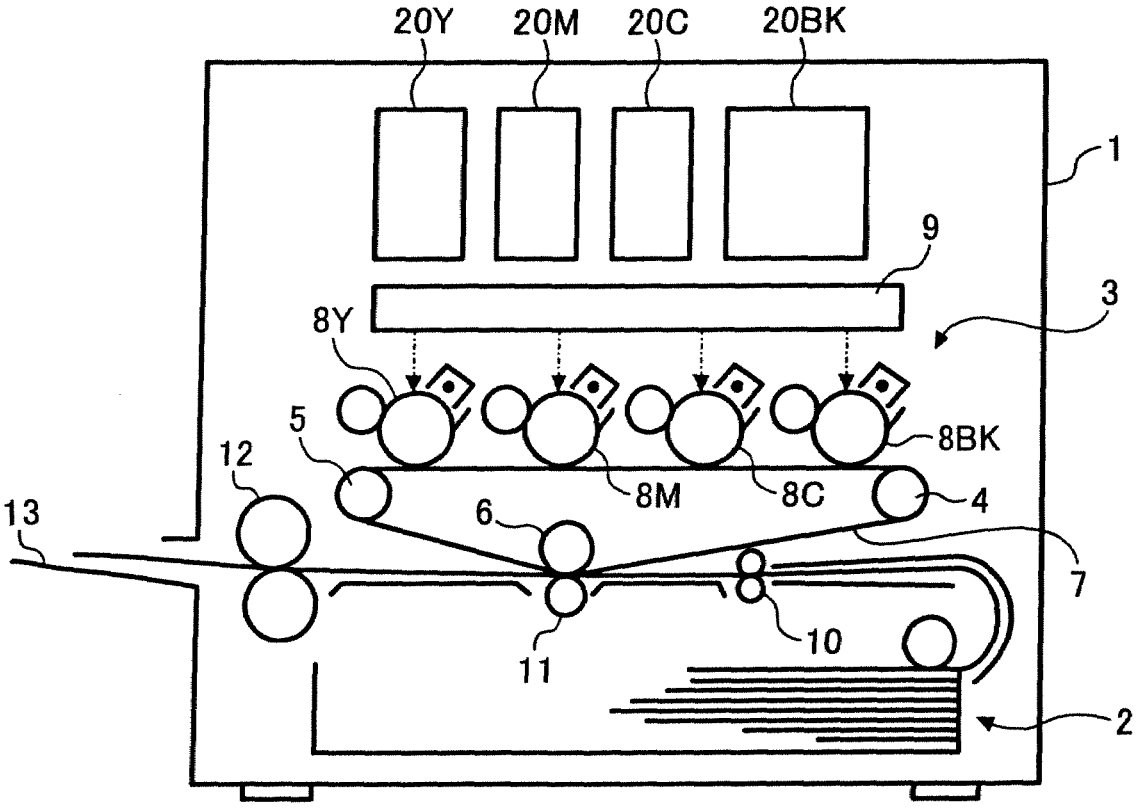
FIG. 1 is a view showing the general construction of an image forming apparatus to which a toner container embodying the present invention is applied.

Referring to FIG. 1 of the drawings, an image forming apparatus to which a preferred embodiment of the present invention is shown and implemented as a color laser printer by way of example. As shown, the color laser printer includes a casing or body 1. An image forming section 3 is arranged at substantially the center of the casing 1 while a sheet feeding section 2 is positioned below the image forming section 3. The image forming section 3 includes an endless, intermediate image transfer belt (simply belt hereinafter) 7 passed over a plurality of rollers 4, 5 and 6. Four image forming units or means 8Y(yellow), 8M (magenta), 8C (cyan) and 8BK (black) are arranged side by side to face the upper run of the belt 4 and 5 between the rollers 4 and 5.

The image forming units 8Y, 8M, 8C and 8BK are identical in configuration with each other except that they use yellow toner, cyan toner, magenta toner and black toner, respectively. the image forming units 8Y through 8BK each include a photoconductive drum or image carrier contacting the belt 7 and electrophotographic process units including a charger, a developing unit and a cleaning unit. An optical writing unit or means 9 is positioned above the image forming units 8Y through 8BK and scans the surface of each drum with a laser beam modulated in accordance with image data. While a particular optical writing unit may be assigned to each image forming unit 8, a single optical writing unit 9 is desirable from the cost standpoint.

In operation, toner images are formed on the drums of the image forming units 8 by an electrophotographic process and sequentially transferred to the belt 7 one above the other by image transferring means, not shown, completing a four-color or full-color toner image on the belt 7. A paper sheet, resin sheet or similar sheet-like recording medium is fed, in synchronism with the toner image being conveyed by the belt 7, to a position where a roller 6 and a secondary image transferring device 11 face each other via a registration roller pair 10. At this instant, a voltage opposite in polarity to toner, forming the full-color toner image, is applied to the secondary image transferring device 11, so that the toner image is transferred from the belt 7 to the sheet. Subsequently, the full-color toner image is fixed on the sheet by a fixing unit 12 using heat and pressure. The sheet or print, coming out of the fixing unit 12, is driven out of the casing 1 to a print tray 13.

It is to be noted that the four image forming units 8Y through 8BK may be selectively used to form, e.g., a black-and-white image or a bicolor or a tricolor image.

Figure 2:
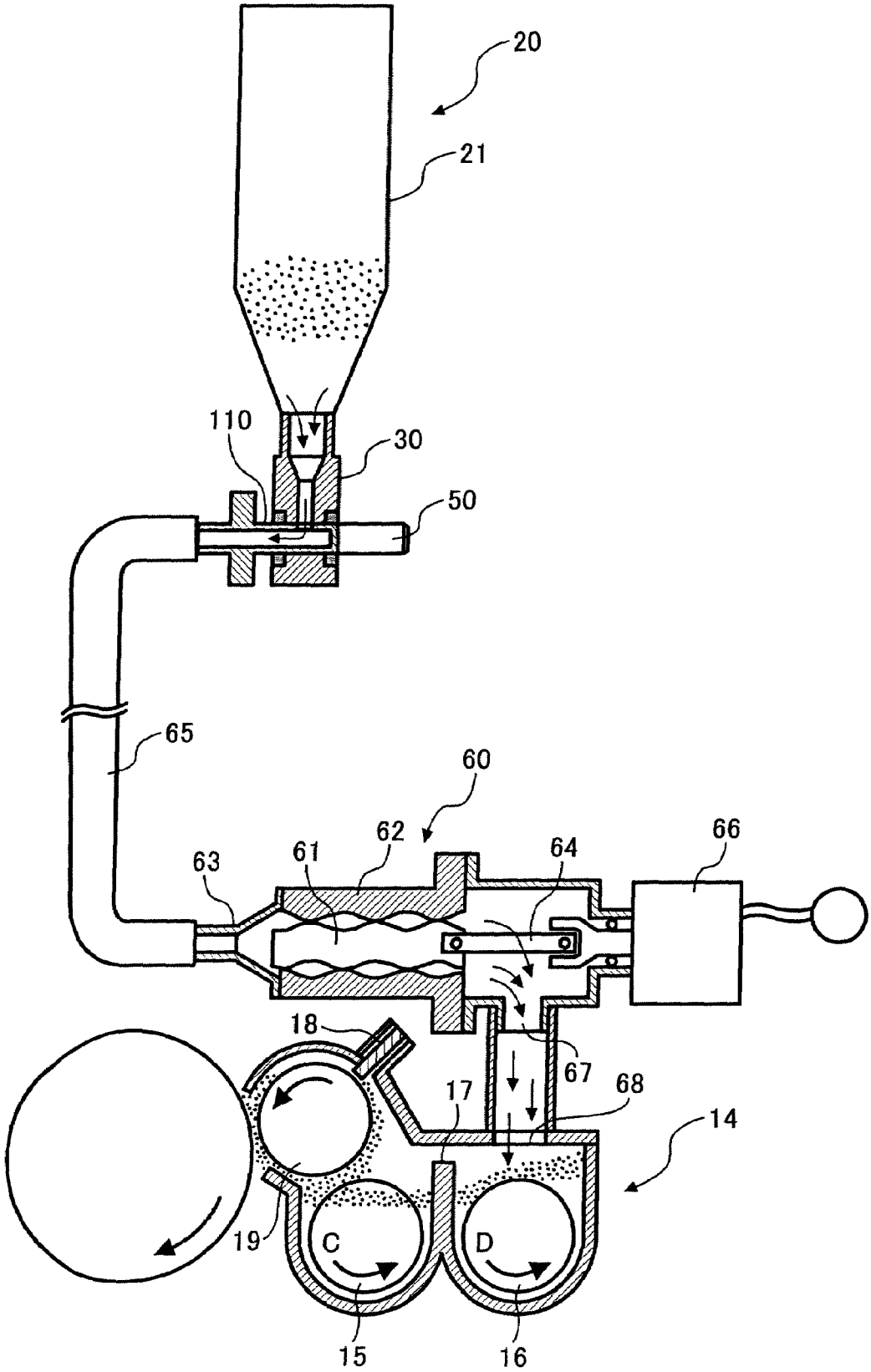
FIG. 2 is a section showing a toner replenishing device included in the apparatus of FIG. 1.
Figure 3:
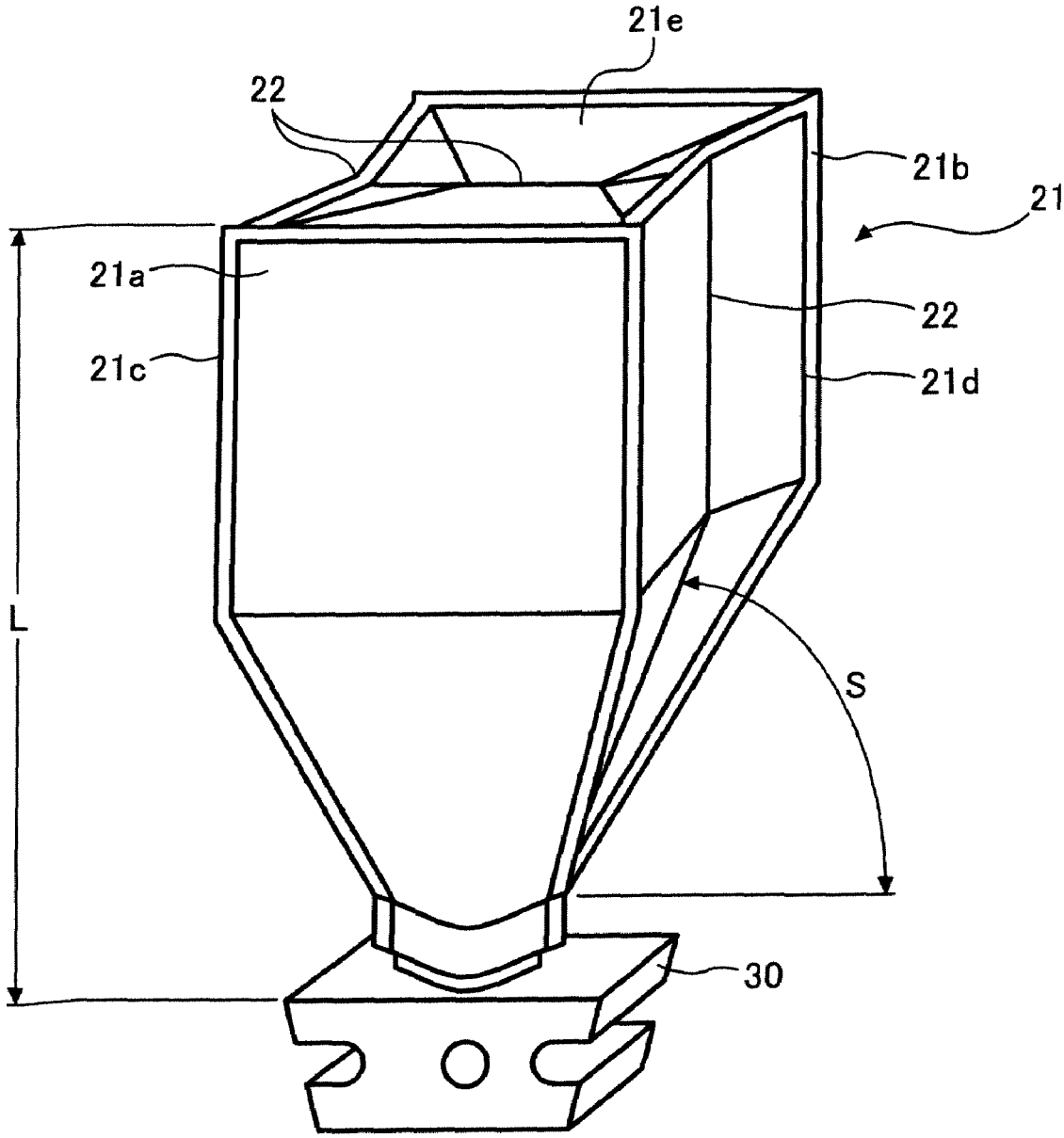
FIG. 3 is an isometric view showing the toner container of the illustrative embodiment in a packed condition.

FIG. 2 shows a powder replenishing device embodying the present invention and implemented as a toner replenishing device. As shown, the toner replenishing device includes a toner or powder container 20 storing fresh toner therein. As shown in FIGS. 2 and 3, the toner container 20 is made up of a bag-like toner or powder storing body (bag hereinafter) 21 and a mouth member 30 formed with a single outlet for delivering toner from the bag 21. The mouth member 30 is affixed to an open portion included in the bag 2 and plays the role of a powder discharging member. The configuration of the toner container 20 will be described more specifically later.

As shown in FIG. 2, the toner container 20, mounted to the casing 1, is fluidly communicated to a developing device 14 via a replenishing path. Arranged on the replenishing path are a nozzle 110 connected to the mouth member 30, a powder pump or sucking means 60 configured to deliver the toner stored in the toner container 20 to the developing device 14 by suction, and a tube 65 connecting the nozzle 110 and powder pump 60.

Screws or augers 15 and 16 are disposed in the developing device 14 storing a developer, and each is formed with a spiral fin. In the illustrative embodiment, the developer is implemented as a toner and carrier mixture. The screws 15 and 16 are rotated in directions C and D, respectively, so as to convey the developer rearward and forward, respectively, as viewed in FIG. 2. A partition 17 isolates the screws 15 and 16 from each other except for the front end and rear end, as viewed in FIG. 2. The developer is therefore circulated by the screws 15 and 16 while being agitated thereby. Part of the developer being circulated is magnetically deposited on a developing roller 19, regulated to preselected thickness by a doctor blade 18, and then brought into contact with the drum to thereby develop a latent image formed on the drum, forming a corresponding toner image on the drum. Because only the toner of the developer deposits on the drum, fresh toner is replenished to the developing device 14 via an inlet port 68 little by little in order to maintain the toner content of the developer constant.

The powder pump 60, which is a single-axis screw pump, consists mainly of a rotor 61 and a stator 62. The rotor 61 is implemented by a hard shaft member having a circular cross-section and spirally twisted. The rotor 61 is connected to a motor 66 by a universal joint 64. The stator 62 is formed of rubber or similar soft material and has a bore having an oblong cross-section spirally twisted. The stator 62 has a spiral pitch two times as great as the spiral pitch of the rotor 61. When the rotor 61 is rotated, the powder pump 60 conveys the toner introduced into the space between the rotor 61 and the stator 62.

More specifically, when the rotor 61 is rotated, the toner is sucked from the tone container 20 into the powder pump 60 via a toner inlet 63, conveyed from the left to the right, as viewed in FIG. 2, and then dropped into the developing device 14 via a toner outlet 67 and the toner port 68.

The bag 21 of the toner container 20 is constituted by sheets formed of a flexible material. More specifically, as shown in FIG. 3, the bag 21 has two sheets 21*a* and 21*b* at the front and rear, respectively, two sheets 21*c* and 21*d* at the left and right, respectively, and a top sheet 21*e*. The sheets 21*a* through 21*e* are connected together at their edges. The sheets 21*c* and 21*d* each are formed with a fold 22. The sheets 21*c* and 21*d* remain flat when the bag 21 is packed with the toner, but folds inward at the folds 22 and contact or adjoin each other when the bag 21 is empty.

Causing the bag 21 to be folded up not manually, but automatically due to toner consumption, is desirable because it saves time and labor and prevents the toner from being scattered around. Only if the replenishing path between the toner container 20 and the powder pump 60 is maintained air-tight, the volume of the bag 21 can be easily, automatically reduced. However, for automatic volume reduction, some other targets must be tackled. For example, such toner containers 20 must be folded up in generally the same configuration in order to obviate an extra rearranging step; otherwise, automatic volume reduction would become meaningless.

The folds 22 are the most effective implementation for uniforming the configuration of the toner containers 20 after the toner containers 20 have been reduced in volume. However, the folds 22 bring about another problem that the toner is sandwiched between the front and rear sheets 21*a* and 21*b* and the right and left sheets 21*c* and 21*d*, which are folded, and left there without dropping to the outlet.

Experiments conducted to solve the above problem showed that it was effective to provide the front, rear, right and left sides of the bag 21 with inclined surfaces such that the cross-sectional area of the bag 21 decreased toward the outlet, and that the inclination of the inclined surfaces was important. More specifically, toner with high fluidity can smoothly move to the outlet even if the inclination is small, but toner with low fluidity cannot do so unless the inclination is great.

Figure 4:
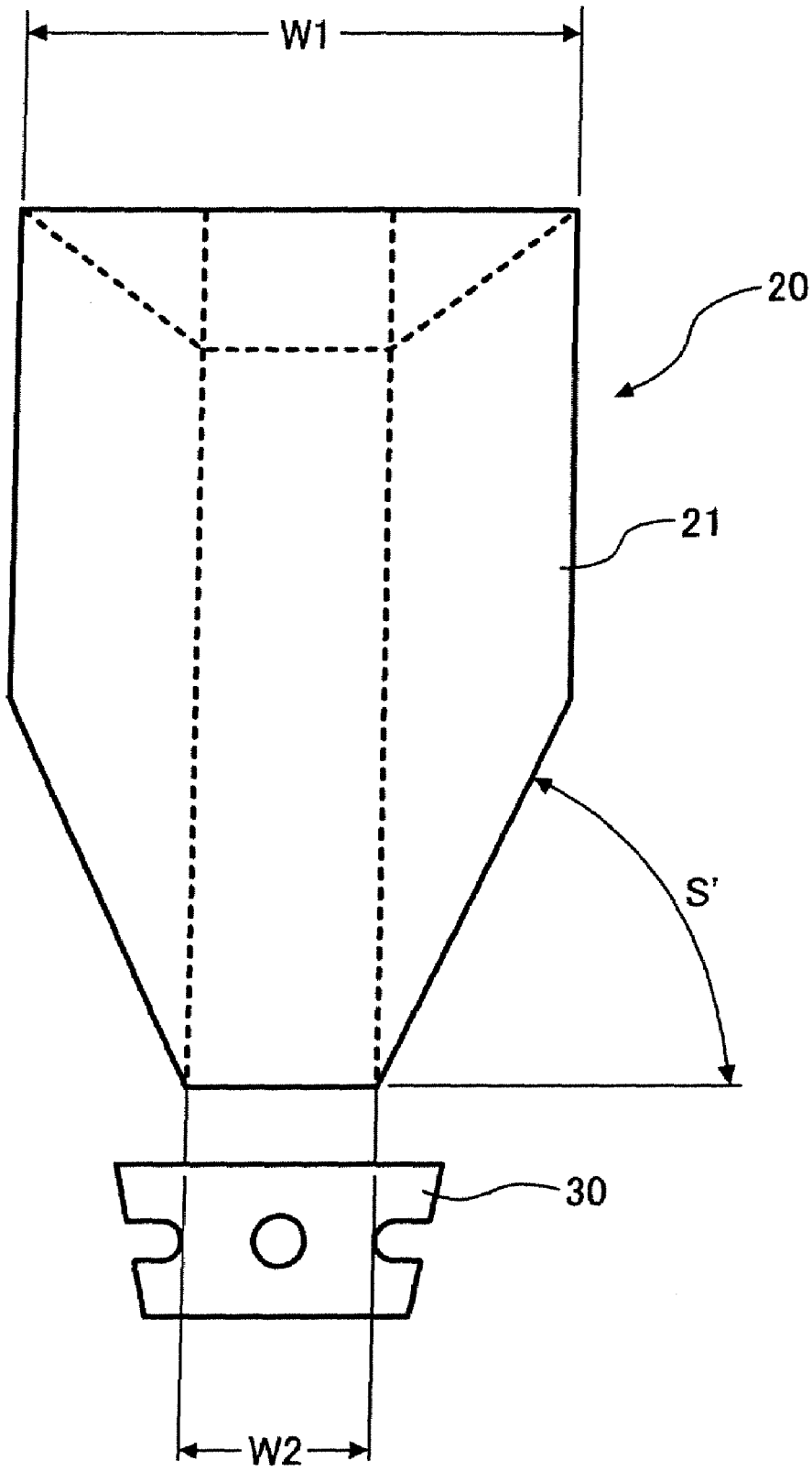
FIG. 4 is a view showing the toner container in a folded position.

We examined the inclination in terms of the angle of repose and found that the amount of toner to be left in the bag 21 after volume reduction could be noticeably reduced if the angle of the inclined surfaces in the full condition of the bag 21 was equal to or greater than the angle of repose of toner. Such an angle of the inclined surfaces is labeled S in FIG. 3. As shown in FIG. 4, assume that when the bag 21 is folded up, the angle of each connected portion is S'. Then, there holds:

$$S' = \tan^{-1}(1/\cos\phi) \qquad \text{Eq. (1)}$$

where $\phi$ denotes the angle of repose of the toner.

Fore example, when the angle of repose of the toner is 40°, the angle S in the full condition is 40° or above if the angle S' of the connected portions is 52.55° or above, i.e., $S'=\tan^{-1}(1/\cos 40)=52.55°$.

In this connection, toner image Toner Type 15 (trade name) available from RICOH CO., LTD. has an angle of repose of 30.5°; the angle S' is 49.3o in accordance with the Eq. (1). It is to be noted that the angle S' should preferably be greater by about 2° to 5° because the fluidity of toner is susceptible to environmental conditions including temperature and humidity. While the angle S' maybe, e.g., 60° or above when consideration is given only to the amount of toner to remain, an increase in angle S' directly translates into a decrease in the amount of toner to be packed for a unit area of the container.

Figure 5:
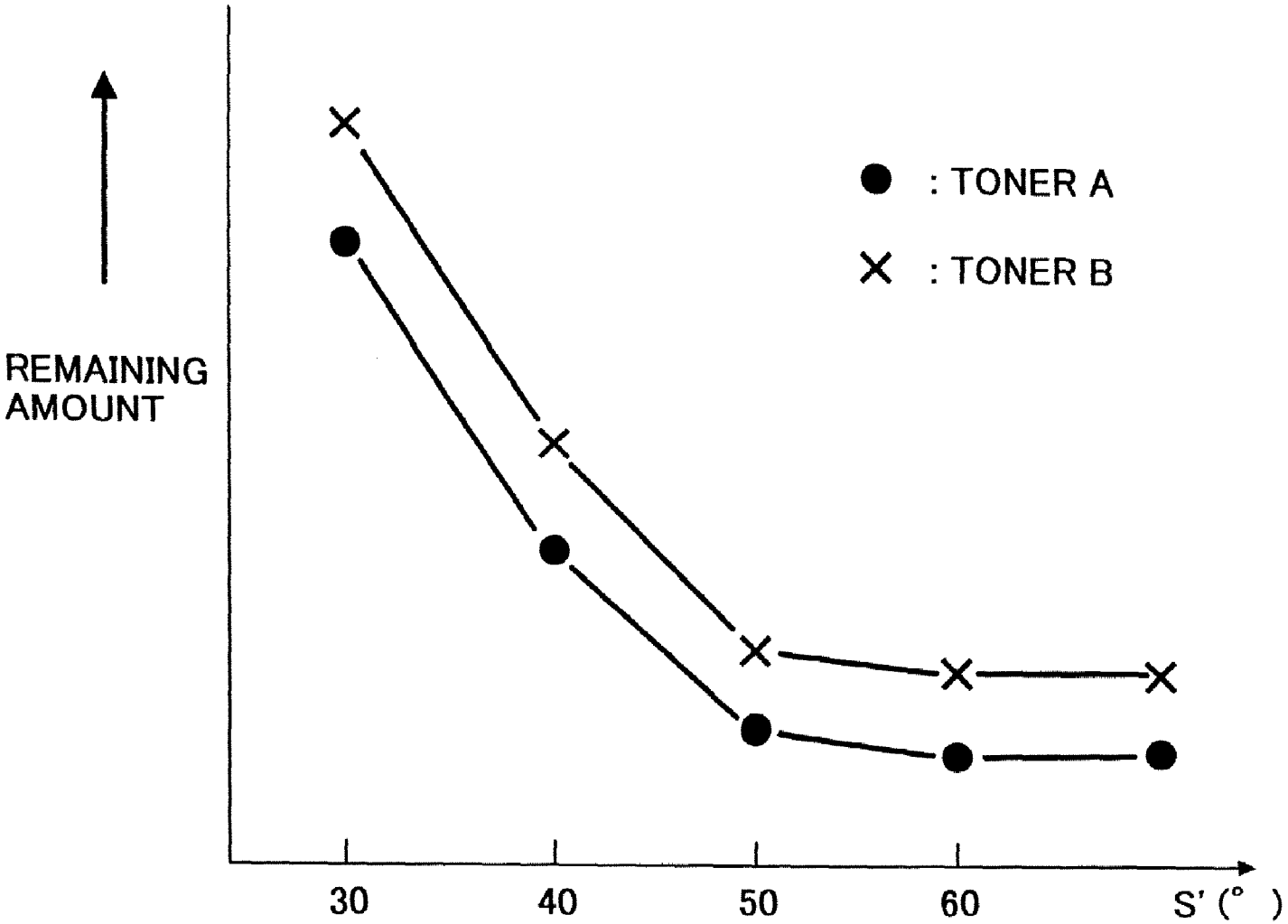
FIG. 5 is a graph showing a relation between the angle of inclined surfaces included in the toner container and the amount of toner left in the toner container.

FIG. 5 shows a relation between the angle S' and the amount of toner to be left in the toner container 20 after volume reduction, as determined by experiments. The experiments were conducted with toner containers each having width of about 90 mm, depth of about 60 mm, and height of about 180 mm (excluding a mouth member). In FIG. 5, toner A has high fluidity, i.e., a cohesion degree as low as 5 while toner B has low fluidity, i.e., a cohesion degree as high as 20. The toners A and B both lie in a customary range.

To determine a cohesion degree, 150 μm, 75 μm and 45 μm sieves were stacked and subjected to oscillation for 20 seconds to pass 2 g of toner. Subsequently, the amounts of toner (g) left on the individual sieves were measured to produce a cohesion degree by using an equation:

$$\text{cohesion degree} = \frac{1}{2}\times\left(a+\frac{3}{5}\cdot b+\frac{1}{5}\cdot c\right)\times 100 \qquad \text{Eq. (2)}$$

where a, b and c respectively denote the amounts of toner left on the 150 μm, 75 μm and 45 μm sieves.

As FIG. 5 indicates, when the angle S' is smaller than 50°, the amount of toner left in the toner container increases. Therefore, to surely discharge the toner, the angle S' should preferably be 50° or above. It is to be noted that the angle S' is determined by the angle of connected portions when sheets are connected in stack. While portions of the sheets outside of the connected portions are shown as being cut away, they may not be cut away, if desired.

Assume that the toner container 20, run out of toner, is folded up by having its front and rear surfaces pressed. Then, if the angle S of the inclined surfaces is less than 45°, then it sometimes occurs that the folds 22 do not fold inward, but protrude outward, preventing the toner container 20 from being neatly folded up. Although the right and rear surfaces may be forcibly folded inward before the entire toner container 20 is folded up, such a procedure is time- and labor-consuming. By contrast, so long as the angle S is 45° or above, the side surfaces smoothly fold inward only if the front and rear surfaces are pressed, allowing the toner container 20 to be neatly folded up.

Figure 6:
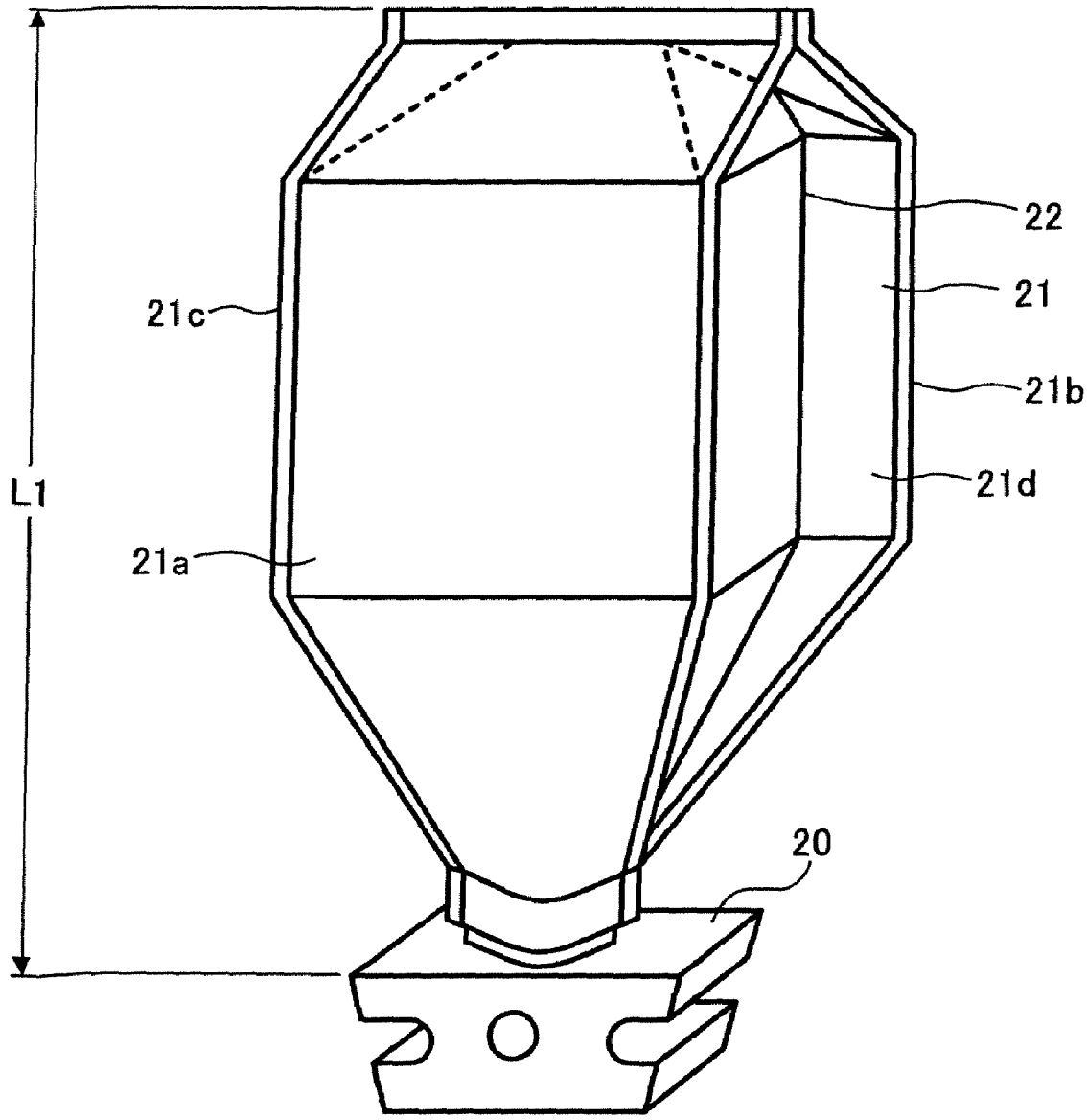
FIG. 6 is an isometric view showing a gazette type toner container.

FIG. 6 shows the toner container 20 provided with a so-called gazette type bag. As shown, the bag 21 is made up of the front and rear sheets 21*a* and 21*b* and left and rear sheets 21*c* and 21*d* that are formed with the folds 22 as in FIG. 3. The sheets 21*a* through 21*d* are adhered together at the top of the toner container 20, as illustrated.

Figure 7:
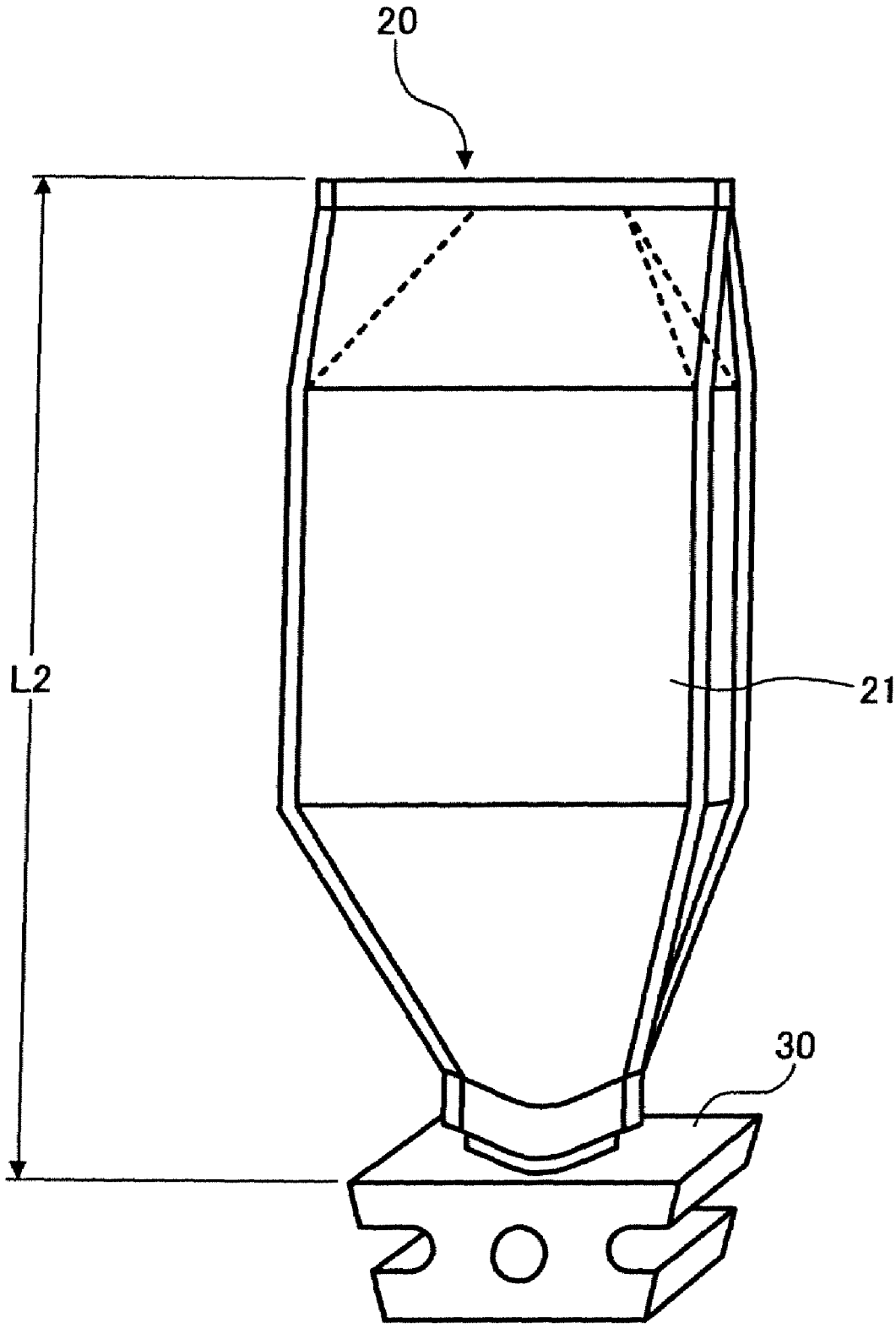
FIG. 7 is an isometric view showing the gazette type toner container in a folded position.

When the toner container 20 with the above configuration is reduced in volume, the right and left sheets 21*d* and 21*c* fold inward in a configuration shown in FIG. 7. The configuration of FIG. 7 has a problem that hardness of the sheets 21*c* through 21*e* thin.

We compared toner containers 20 of the type shown in FIG. 3 as to the easiness of volume reduction in terms of the amount of depressurization necessary for volume reduction. The amount of depressurization refers to a negative difference between the atmospheric pressure and the pressure inside the toner container 20. The amount of depressurization required was 0.5 kPa (kilopascal) to 0.6 kPa when the front and rear sheets and right and left sheets were 160 μm thick each or 0.2 kPa to 0.3 kPa when the former and latter were 160 μm thick and 100 μm thick, respectively. Further, the amount of depressurization was 0.1 kPa to 0.2 kPa when the front and rear sheets and right and left sheets were 160 μm thick and 80 μm thick, respectively, or 0.1 kPa to 0.15 kPa when the former and latter were 160 μm thick and 65 μm thick, respectively.

Each sheet is implemented as a laminate of polyethylene and Nylon sheets while the toner container 20 was about 90 mm wide, about 60 mm deep and about 180 mm high (excluding a mouth member). It was also found that when the right and left surfaces each were 80 μm thick or less, the toner container 20 was stable in configuration when folded up.

It will therefore been seen that when all the sheets are formed of the same material, the thickness of the right, the height of the toner container 20 increases. More specifically, because the top of the toner container 20 folds in two, the original height L1 increase to height L2. As a result, to automatically reduce the volume of the toner container 20 within the casing 1, a space whose height is L2 must be provided in the casing 1.

In light of the above, as shown in FIG. 3, the top sheet 21*e* should also preferably be provided with a fold 22 that folds inward, so that the original height L increases little when the toner container 20 is folded up. Further, when the volume of the toner container 20 decreases due to the suction of the powder pump 60, the bag 21 tends to contract. Therefore, the directions in which the folds 22 fold inward and the directions in which folding forces act are coincident, allowing the bag 21 to be folded up along the folds 22. By contrast, in the toner container 20 shown in FIG. 6, the above directions are opposite to each other and cause the folded configuration to easily differ from one toner container to another.

Another important factor relating to the volume reduction of the toner container 20 is the thickness of the individual sheet constituting the container 20. As for the toner container 20 shown in FIG. 3, to allow the right, left and top sheets 21*d*, 21*c* and 21*e* to fold inward, it is important to reduce the thickness and therefore left and top sheets should be one-half of the thickness of the front and rear sheets or less.

Alternatively, when the sheets of the toner container 20 shown in FIG. 3 all are formed of the same material, members higher in hardness than the front and rear sheets 21*a* and 21*b* and formed of, e.g., PET, PE or similar resin may be adhered to the sheets 21*a* and 21*b* to thereby establish a difference in hardness between the front and rear sheets and the right, left and top sheets. In this case, the rigid members thus adhered to the front and rear sheets each may be formed with, e.g., an oblong concavity, so that a person can surely hold the toner container 20 by putting fingers in such concavities.

Figure 8:
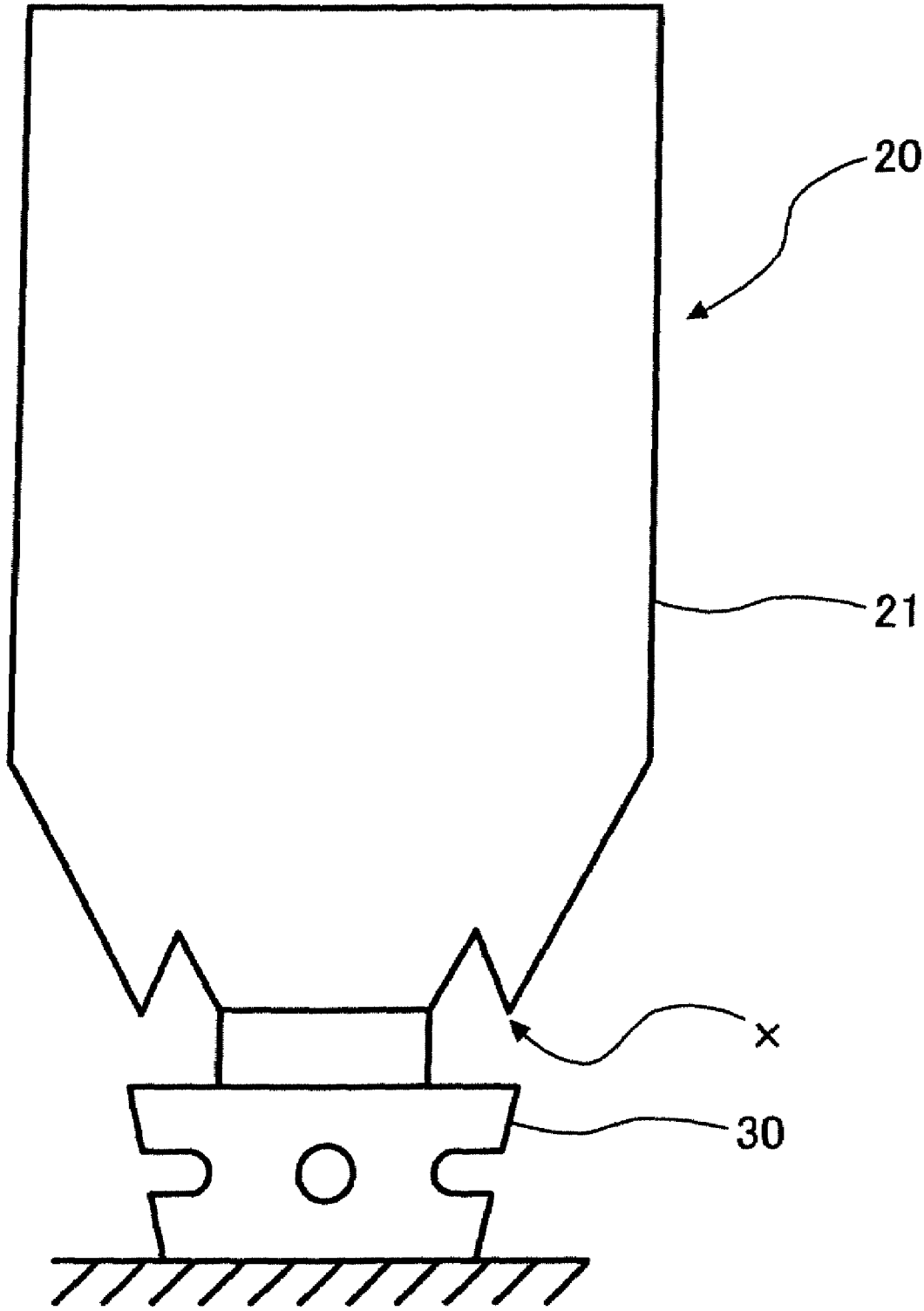
FIG. 8 is a view demonstrating how the toner container buckles.

FIG. 8 demonstrates how the toner container 20 buckles when mounted to the casing 1 and supported by the mouth member 30. As shown, because the horizontal sectional area and therefore strength of the toner container 20 is small around the mouth member 30, the container 20 buckles in the vicinity of the mouth member 30 due to the weight of toner stored therein. The buckling of the toner container 20 undesirably increases the amount of toner to be left in the container 20.

While support portions for supporting the right and left inclined surfaces of the toner container 20 may be used to obviate buckling stated above, this scheme obstructs the volume reduction of the container 20. Moreover, the mouth member 30 is apt to fail to accurately reach a preselected mount position. In light of this, as shown in FIG. 4, assuming that the mouth member 30 is affixed to the sheets over a width W2 and that the toner container 20 has a width of W1, then the width W2 should preferably be one-fourth of the width W1 or above.

Figure 9:
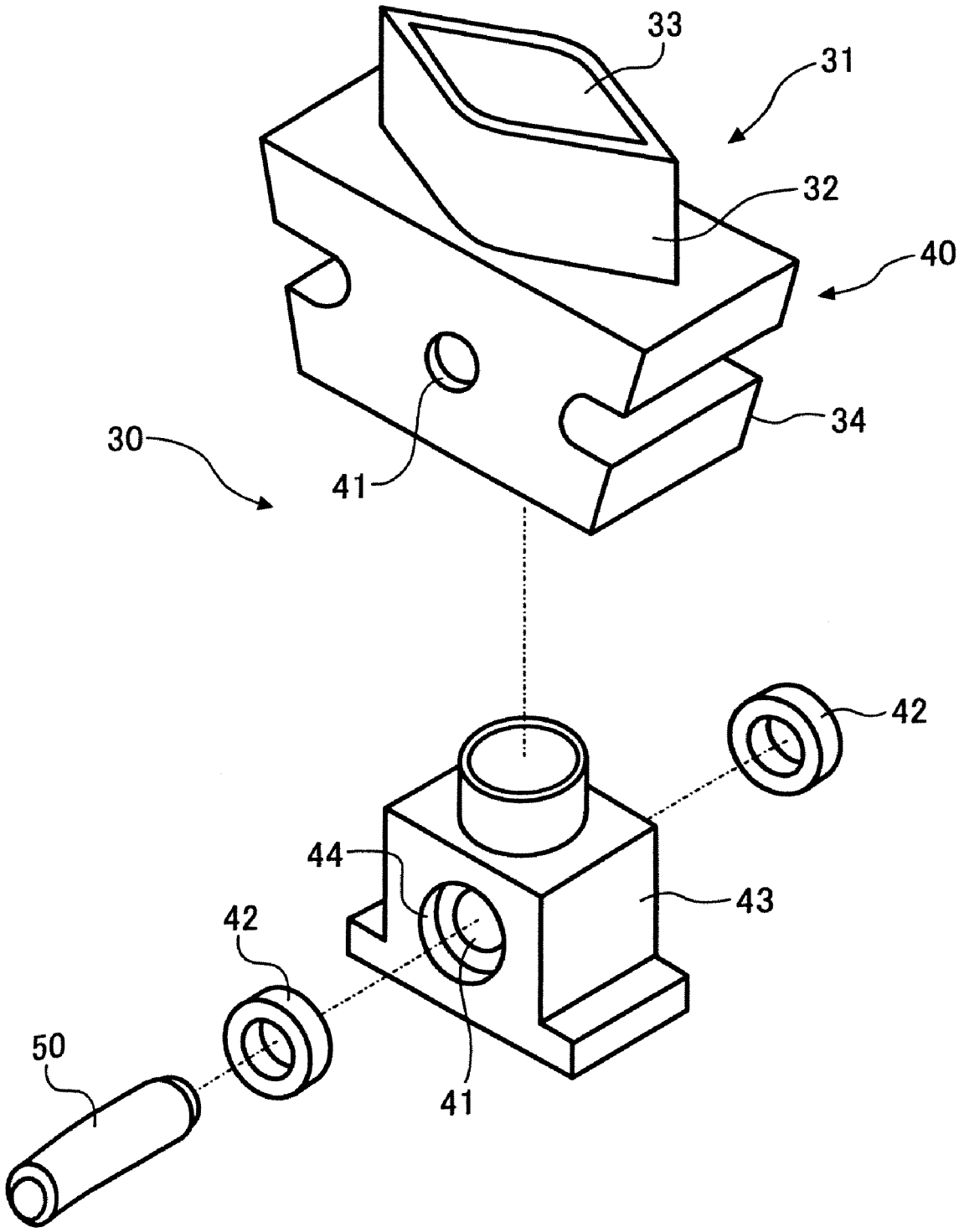
FIG. 9 is an exploded isometric view showing a mouth member included in the illustrative embodiment.
Figure 10:
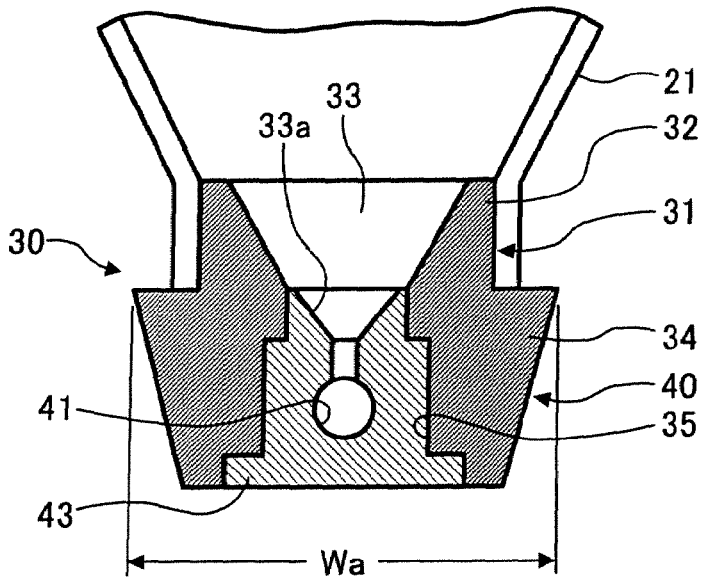
FIG. 10 is a horizontal section of the mouth member.
Figure 11:
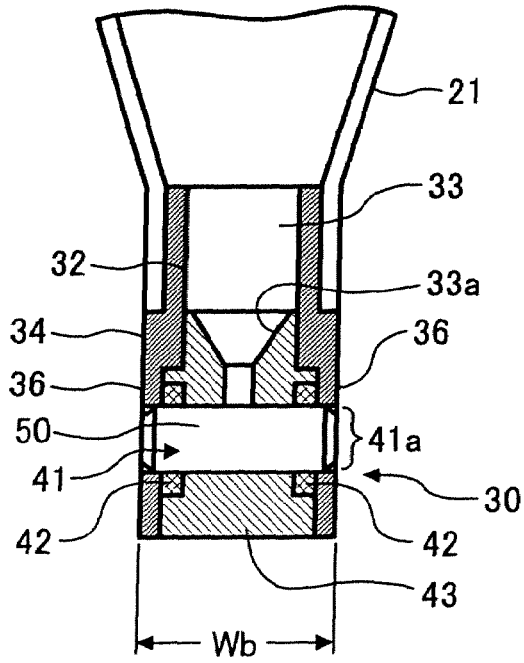
FIG. 11 is a vertical section of the mouth member.

A specific configuration of the mouth member 30 will be described with reference to FIGS. 9 through 11. As shown, the mouth member 30 is made up of an upper and a lower body portion 31 and 40, respectively. An bag support portion 32 to which the bag 21 is to be affixed is formed on the top of the upper body portion 31 and provided with a boat shape, as seen from the above. The lower body portion 40 is generally rectangular; assuming that the surface shown in FIG. 9 is a front surface, then the front and rear surfaces have a width Wa larger than the with Wb of the opposite side surfaces.

The mouth member 30 is formed with a toner passage constituted by a bore 33 adjacent to the bag 21 and a shutter hole 41 into and out of which a shutter member 50, which will be described later, is movable. While the bore 33 extends in the up-and-down direction when the mouth member 30 is positioned face down, the shutter hole 41 extends substantially perpendicularly to the axis of the bore 33. In the illustrative embodiment, the shutter hole 41 extends throughout the lower body portion 40 from the front to the rear.

The bore 33 has a circular section having a diameter equal to the shorter length of the boat-shaped bag support portion 32 and includes a funnel-like tapered portion 33*a*, which decreases in area little by little toward the shutter hole 41 and is communicated to the shutter hole 41 at a position above the shutter hole 41. Consequently, the diameter of the bore 33 is smaller than the diameter of the shutter hole 41 at the position where the former is communicated to the latter. Therefore, the shutter member 50, inserted into the shutter hole 41, surely blocks the toner passage.

In the illustrative embodiment, the shutter member 50 is implemented as a pin having a circular cross-section and slightly smaller in diameter than the shutter hole 41, so that the shutter member 50 can be surely inserted into the shutter hole 41. In this condition, however, toner or air leaks via the gap between the shutter member 50 and the wall of the shutter hole 41, smearing surrounding members or obstructing the volume reduction of the toner container 20.

To obviate leakage mentioned above, O-rings 42, each having a pentagonal cross-section, are fitted at opposite sides of the through shutter hole 41 and play the role of sealing means for sealing the gap between the mouth member 30 and the shutter member 50. While the O-rings 42 may be fitted in annular grooves formed at the opposite sides of the shutter hole 41 and affixed by, e.g., adhesive, this scheme is time- and labor-consuming and increases cost.

In light of the above, in the illustrative embodiment, the mouth member 30 is implemented as an inner part 43 and an outer part 34 configured to retain the O-rings 42 when engaged with each other. More specifically, the inner part 43 is formed with annular grooves 44 for receiving the O-rings 42*d* while the outer part 34 is formed with a mount portion 35 for mounting the inner part 42, the bag support portion 32 stated earlier, and portions 36 for holding the O-rings 42 fitted in the grooves 44. When the inner part 43 loaded with the O-rings 42 is mounted to the outer part 34, the O-rings 42 are pressed by the portions 36 and therefore surely prevented from slipping out.

The shutter hole 41 extends throughout the inner part 43 and outer part 34. After the inner part 43 has been mounted to the mount portion 35 of the outer part 34, the shutter member 50 is inserted into the shutter hole 41 to thereby affix the inner part 43 to the outer part 34. The mount member 30 can be easily disassembled into the outer part 34 and inner part 43 only if the shutter member 50 is pulled out of the shutter hole 41. This, however, brings about a problem that toner leaks from the full toner container 20 if the shutter member 50 is pulled out by accident. In the illustrative embodiment, the shutter member 50 is provided with a diameter as small as about 8 mm, preferably 6 mm that is too small to be moved by finger. More specifically, if the diameter of the shutter member 50 is 10 mm, then it is likely that the shutter 50 is moved by finger and causes toner to leak.

Figure 12:
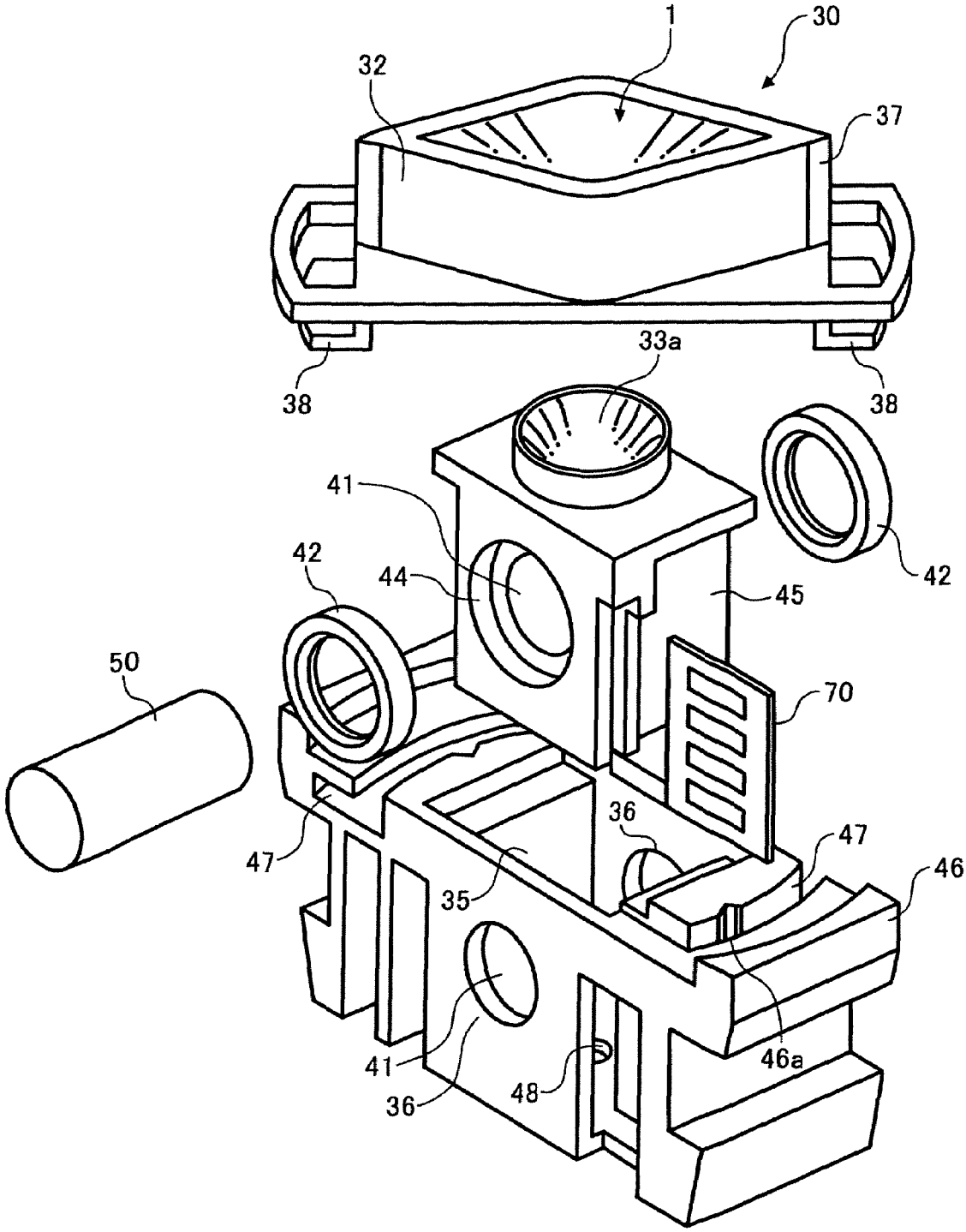
FIG. 12 is an exploded isometric view of a mouth member representative of an alternative embodiment of the present invention.
Figure 13:
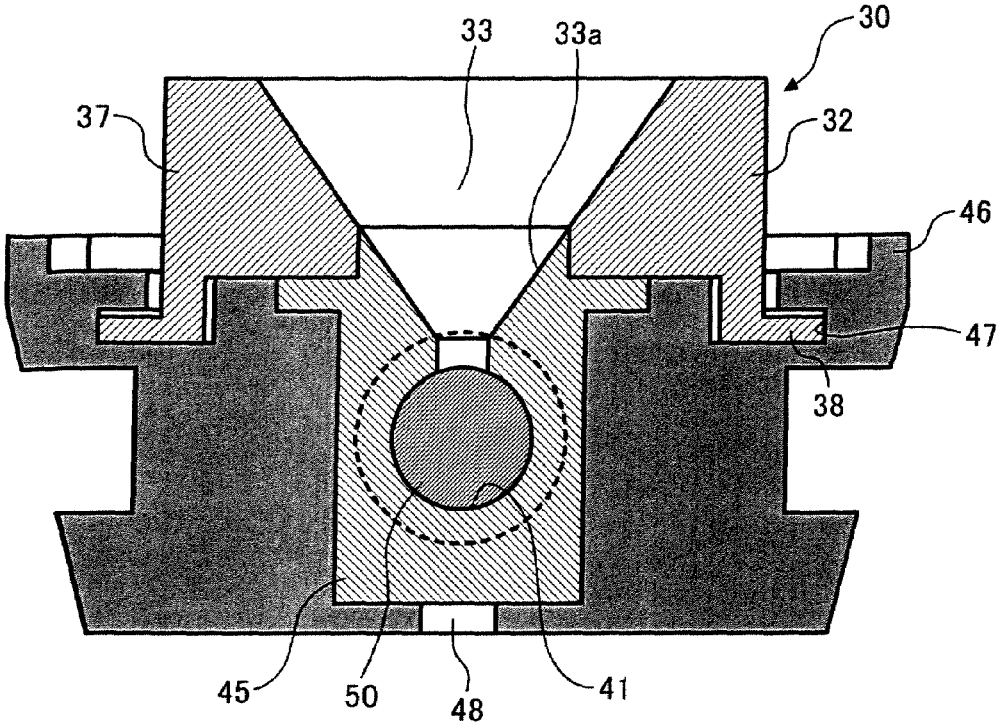
FIG. 13 is a horizontal section of the mouth member.
Figure 14:
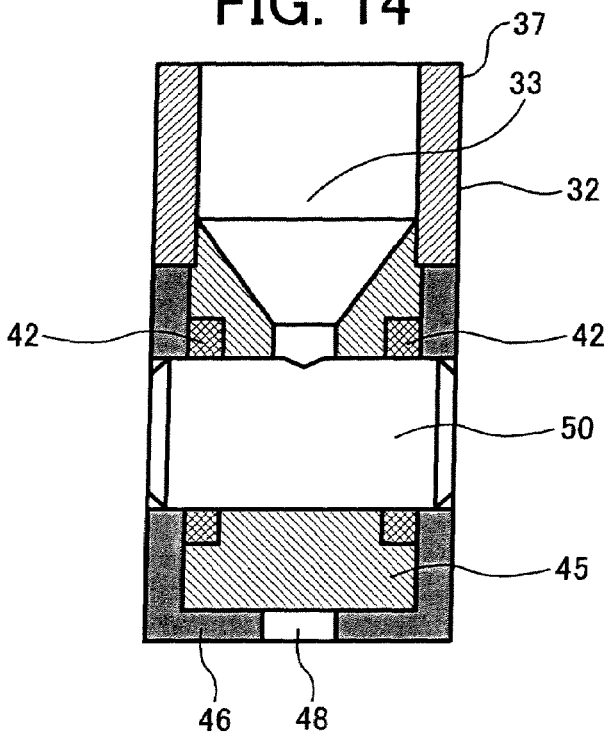
FIG. 14 is a vertical section of the mouth member.

Reference will be made to FIGS. 12 through 14 for describing an alternative embodiment of the present invention. As shown, the mouth member 30 is generally made up of an upper part or base member 37 and an inner and a lower part 45 and 46, which constitute an outlet member in combination. The upper member 37 is formed with the bag support portion 32 and guides or guide means 38 to be engaged with the lower part 46. The lower part 46 is formed with the mount portion 35 assigned to the inner part 45, the portions 36 assigned to the O-rings 42, and guide channels 47 for receiving the guides 38.

In the illustrative embodiment, the shutter hole 41 extends throughout the inner part 45 and lower part 46. After the inner part 45 with the O-rings 42 fitted in the annular grooves 44 has been mounted to the mount portion 35 of the lower part 46, the shutter member 50 is inserted into the shutter hole 41 to thereby assemble the lower part 46 and inner part 45. Subsequently, when the upper part 37 is turned with the guides 38 being received in the guide channels 47, the upper part 37 and lower part 46 are connected together, completing the mouth member 30. Locking means locks the upper part 37 and lower part 46 when the two parts 37 and 47 are accurately connected together. The locking means comprises nail portions, not shown, included in the upper part 37 and grooves 46*a* formed in the lower part 46. Although the bore 33 extends throughout the upper part 37 and inner part 45, the bore 33 is prevented from being shifted because the upper part 37 and lower part 46 are connected together by being turned about the axis of the bore 33.

To disassemble the mouth member 30, after the upper part 37 has been removed from the lower part 46, an elongate tool is inserted into a through hole 48, which is formed in the bottom the lower part 46, to thereby push the inner part 45 upward. As a result, the inner part 45 can be easily removed from the lower part 46.

When the mouth member 30 is made up of two parts as in the previous embodiment, the bore 33 extends throughout the outer member 34 and inner member 43. In the illustrative embodiment, the bore 33 extends throughout the upper part 37 and inner part 45, which are two of the three parts constituting the mouth member 30. In both of the two embodiments, the funnel-like tapered portion 33*a* included in the bore 33 is formed in the inner part 43 or 45.

Toner is packed in the toner container 20 in a factory. It is difficult to pack toner in the toner container 20 via the shutter hole 41, which extends in a different direction from the bore 33. It is also difficult to pack toner via an opening, which may be formed in the bag 21, because the bag 21 inflates before the opening is sealed later. In the illustrative embodiments shown and described, before the inner part 34 or 45 is mounted, the bore 33 is relatively wide open because the tapered portion 33*a* is absent in the bore 33. Toner can therefore be easily packed before the inner part 34 or 45 is mounted, in which case the inner part 34 or 45 will hermetically close the bag 21 when mounted later. In this manner, the mouth member 30 made up of two or three parts facilitates the packing of toner.

In the case of the mouth member 30 made up of two parts, it is necessary to mount, after packing, the inner part 43 to the outer part 34 and then insert the shutter member 50. By contrast, in the case of the mouth member 30 made up of three parts, only if the shutter 40 is inserted into the subassembly of the inner part 45 and lower part 46 beforehand, it suffices to connect the lower part 47 to the upper part 37 after packing.

Figure 15:
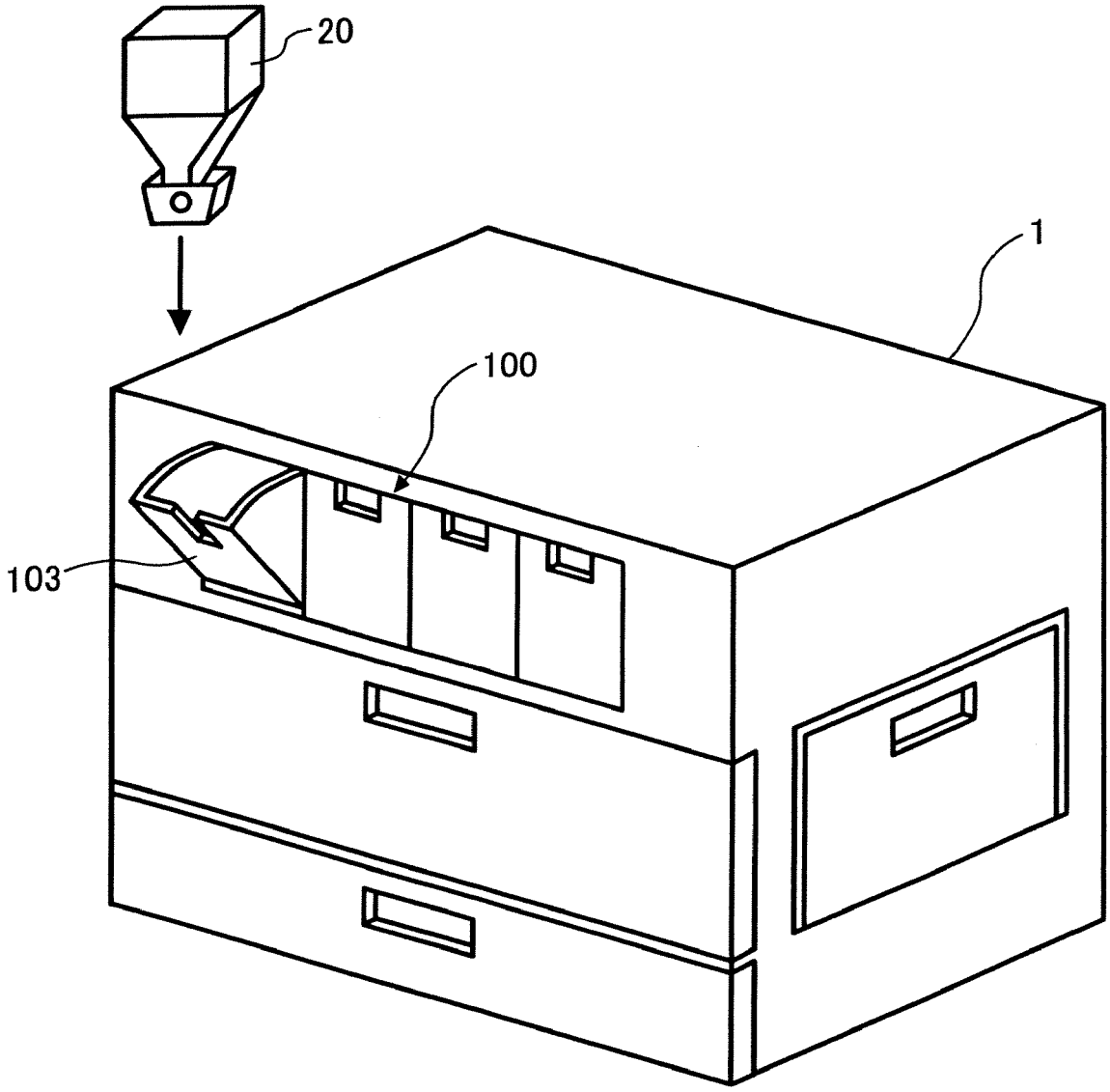
FIG. 15 is an external view showing the apparatus of FIG. 1.

Reference will be made to FIG. 15 for describing mount portions included in the casing 1 for mounting the toner containers 20 each storing toner of a particular color. As shown, the casing 1 includes four mount portions 100 identical in configuration with each other although the mount portion 100 assigned to black is larger in width than the other mount portions 100.

Figure 16:
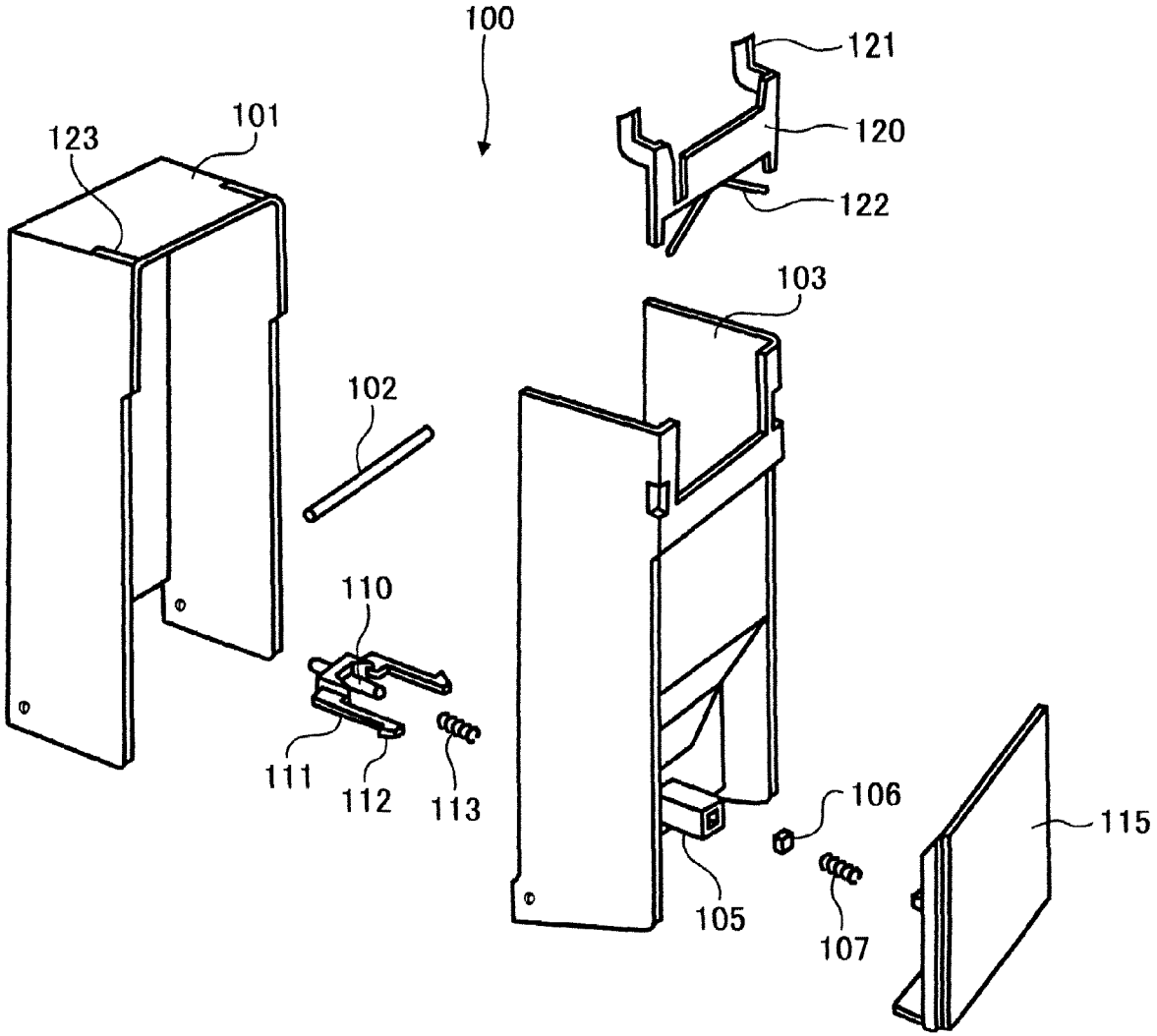
FIG. 16 is an exploded isometric view showing a mount portion included in the apparatus of FIG. 15.
Figure 17:
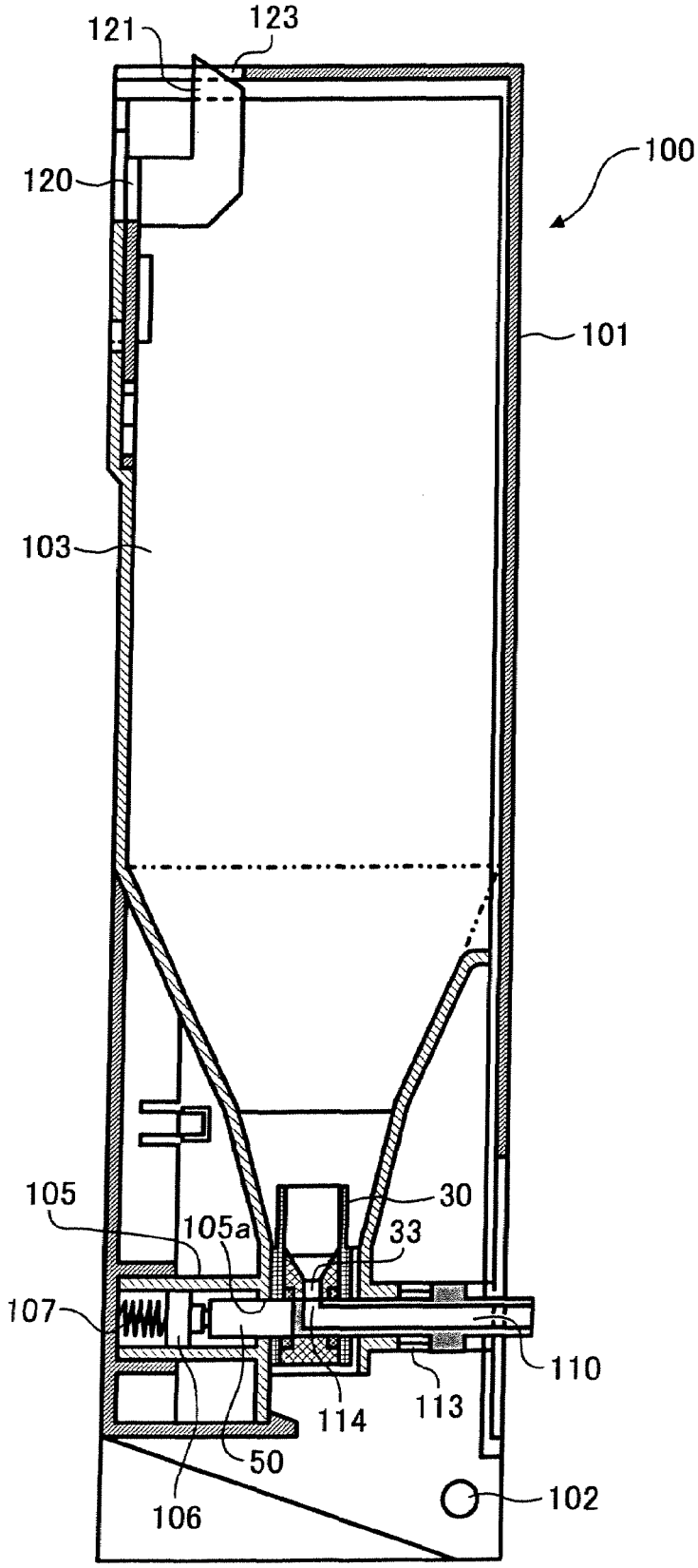
FIG. 17 is a section showing a folder included in the mount portion in a closed position.
Figure 18:
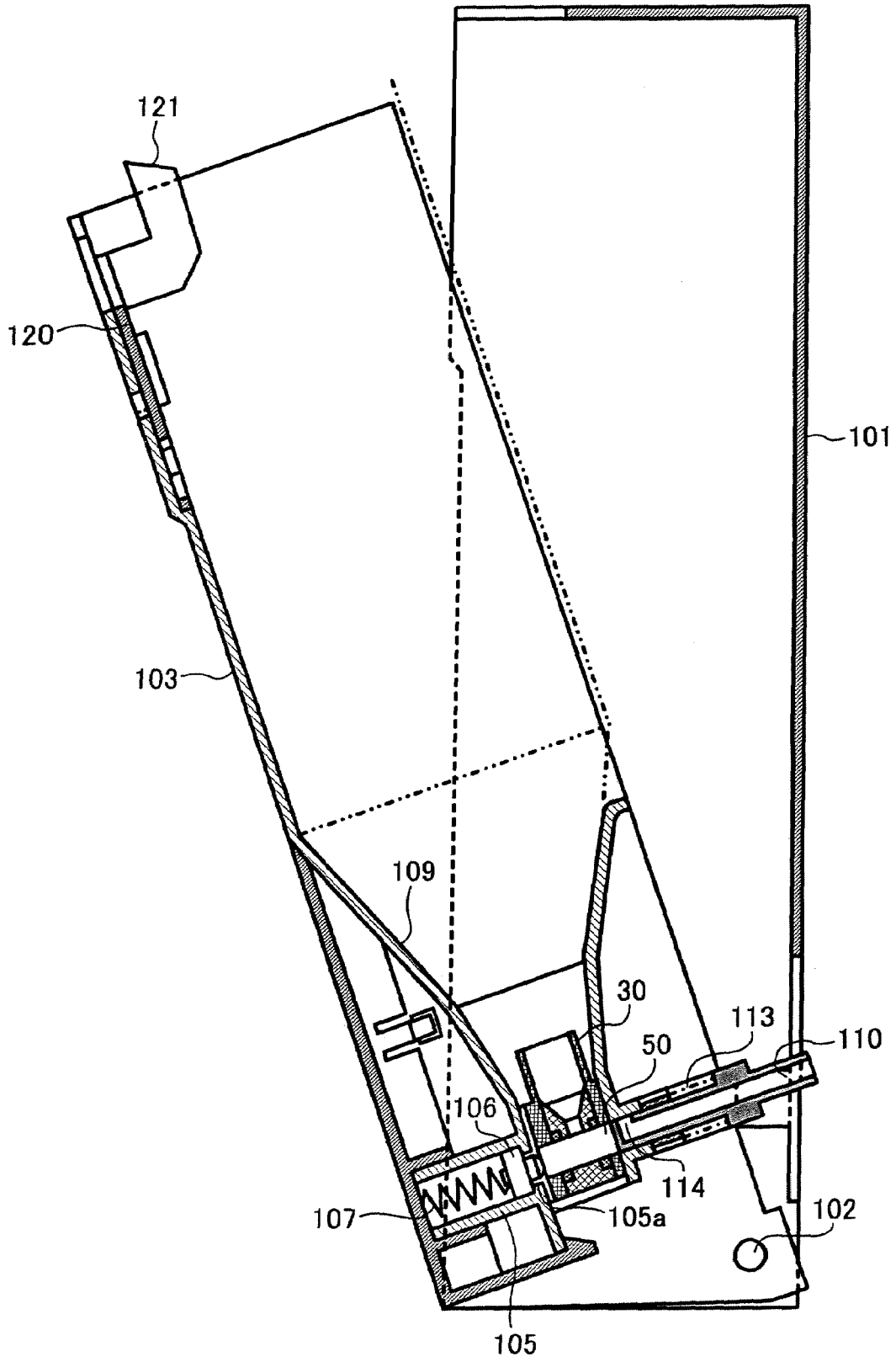
FIG. 18 is a section showing a folder included in the mount portion in an open position.
Figure 19:
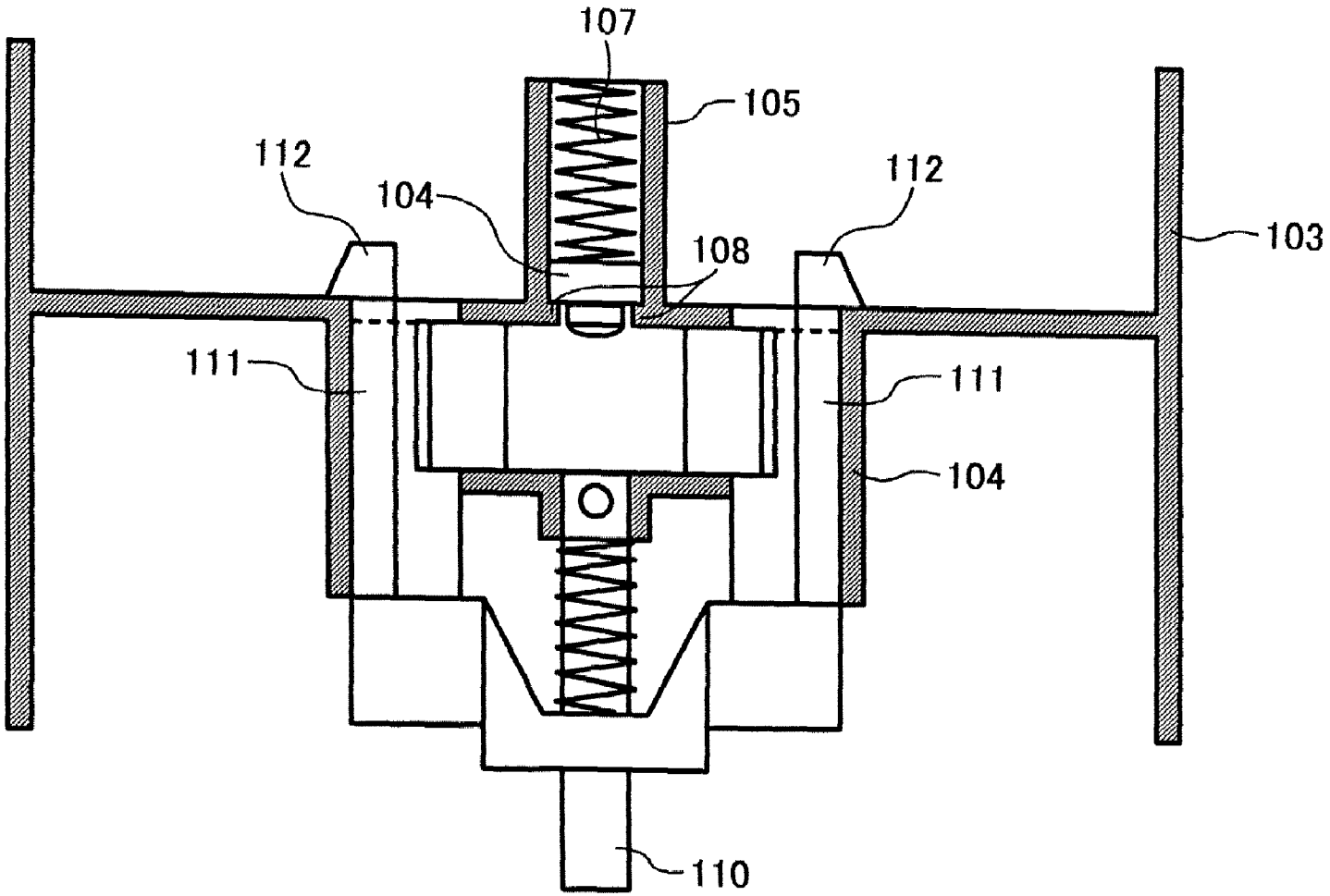
FIG. 19 is a horizontal section of the mount portion.

As shown in FIGS. 16 and 17, each mount portion 100 includes a folder 103 hinged to a frame 101 via a shaft 102 and angularly movable between a closed position shown in FIG. 17 and an open position shown in FIG. 18. As shown in FIG. 19, a pair of guide members 104 and a guide tube 105 are arranged in the lower portion of the folder 103. A nozzle 110 is slidably supported by the guide members 104. A slider 106, serving to return the nozzle 110 inserted, is slidably received in the guide tube 105. A cover 115 covers such constituents. A knob 120, which is formed of resin and movable in the up-and-down direction, is mounted on the upper portion of the folder 103 and includes a locking portion 121 configured to lock the folder 103 in the closed position. An elastic arm 122 is formed integrally with the bottom of the knob 120 and constantly biases the knob 120 toward the uppermost position. The nozzle 110 has the same diameter as the shutter member 50.

Slide arms 111 protrude from opposite sides of the nozzle 110 and are movably supported by the guide member 104. Locking nails 112 are formed at the ends of the slide arms 111 and prevent the nozzle 110 from slipping out of the folder 103 when engaged with the end portions of the guide member 104. A compression spring 113 is wound round the nozzle 110 in the gap between the nozzle 110 and the folder 103, resiliently holding the nozzle 110 at a position where the locking nails 112 are locked to the end portions of the guide member 104.

The guide tube 105, extending on the axis of the nozzle 110, is formed with a hole 105 for inserting the shutter member 50 in the end portion facing the nozzle 110. The other end of the guide tube 105 is closed by the cover 115. The slider 106, formed with a projection, and a compression spring 107, constantly biasing the slider 106 toward the nozzle 110, are disposed in the guide tube 105. A retaining portion 108 is formed in the end of the guide tube 105 adjacent to the nozzle 110 and retains the slider 106 within the guide tube 105 against the action of the compression spring 107.

A guide frame 109 is disposed in the folder 103 for guiding the toner container 20 toward a preselected mount position. The nozzle 110 is positioned in the lowermost portion of the guide frame 109 configured to receive the lower body portion 40 of the mouth member 30. Holes are formed in the guide frame 109 to allow the nozzle 110 and shutter member 50 to pass therethrough.

When a person pulls the knob 120 toward the person while moving it downward, the locking portion 121 is released from a groove 123 formed in the frame 101. As shown in FIG. 18, the folder 103 can be angularly moved or opened about the shaft 102 to a position where the bottom of the holder 103 abuts against the frame 101. In the open position, the nozzle 110 is retracted to the left, as viewed in FIG. 18. In this condition, when the person drops the toner container 20 with the mouth member 30 facing downward, the toner container 20 drops to a position where the shutter member 50 of its mouth member 30 faces the nozzle 110. This is because the nozzle 110 is held in a position where the locking nails 112 are held in contact with the guide members 104 by the compression spring 113.

Subsequently, when the person again closes the folder 103 to the position shown in FIG. 17, the nozzle 110 enters the shutter hole 41 to thereby move the shutter member 50 from the hole 105*a* toward the guide tube 105. At the same time, a toner inlet 114, formed in the upper portion of the nozzle 110 close to the end, is brought into communication with the lower portion of the bore 33 present in the mouth member 30, establishing the replenishing path between the toner container 20 and the developing device 14. It is to be noted that the shutter member 50 forced out toward the guide tube 105 is not fully released from the shutter hole 41, but held partly in the shutter hole 41 and partly in the guide tube 105.

Further, the compression spring 113 is compressed by the folder 103 when the nozzle 110 is inserted into the shutter hole 41, while the compression spring 107 disposed in the guide tube 105 is also compressed by the shutter member 50 via the slider 106. Therefore, when the folder 103 is opened, the nozzle 110 and shutter member 50 are returned to their original positions by the compression springs 113 and 107, respectively. As a result, the nozzle 110 is released from the shutter hole 41 of the toner container while the shutter member 50 is again inserted into the shutter hole 41.

As stated above, only if the toner container 20 is mounted to the casing 1, the toner replenishing path is automatically established. Further, when the folder 103 is opened, the nozzle 110 is released from the shutter hole 41, but the shutter member 50 is immediately returned into the shutter hole 41 to thereby prevent the toner from leaking from the toner container 20.

In summary, in the illustrative embodiments shown and described, only if the outer part 34 or the upper part 37, constituting the base member, and the inner part 43 or the inner part 45 and lower part 46, constituting the outlet member, are released from each other, the outlet member can be separated from the toner container 20 run out of toner. This makes it needless to remove an elastic seal member from a toner outlet member by troublesome operation. Therefore, the bag or powder storing body 21 and container body member implemented by the base member and outlet member can be easily recycled independently of each other. Further, when the outlet member is separated, the opening communicated to the inside of the bag 21 is exposed to the outside and allows powder to be packed via the opening. This promotes easy recycling of the bag 21 as well.

The bore 33 of the outer part 34 or the upper part 37, constituting the base member, has an area, as measured at the outlet, larger than the opening area of the shutter hole or powder outlet 41 of the inner member 43 or 45. Therefore, toner can be easily packed via the outlet of the bore 33 of the outer member 34 or the upper member 37 after the removal of the inner member 43 or 45. In addition, the opening area of the shutter hole 41 formed in the inner part 43 or 45 is small, so that toner is prevented from leaking via the shutter hole 41.

The bore or relay passage 33 of the outer part 34 or the upper part 37, constituting the base member, has a sectional area, as measured in the direction perpendicular to the passage of toner, decreasing from the side adjacent to the opening of the bag 21 toward the inner part or outlet member 43 or 45 little by little. This allows toner discharged from the bag 21 to be smoothly transferred to the inner part 43 or 45 while causing a minimum amount of toner to remain in the bore 33.

The flexible bag 21 deforms in such a manner as to reduce its volume after the toner container 20 has run out of toner. The volume of the toner container 20 can therefore be easily reduced.

The bag 21 includes sheets forming the sides and a sheet forming the top when the base member of the mouth member 30 is positioned at the bottom of the bag 21. Folds formed in such sheets allow the bag 21 to easily fold up without increasing its height.

The sheets, forming the sides of the bag 21, each include an inclined surface inclined toward the base member little by little. The angle of the inclined surface relative to the horizontal is selected to be larger than the angle of repose of toner packed in the bag 21, so that a minimum amount of toner remains in the bag after volume reduction.

The base member of the mouth member 30 is rectangular and includes a pair of side surfaces substantially parallel to the front and rear surfaces of the bag 21. The width between the right and left sides of the bag 21 is selected to be smaller than the width between the above pair of side surfaces, so that the bag 21 can be folded up in a thin configuration after volume reduction.

The front and rear sheets of the bag 21 are harder than the right and left sheets and further promotes easy volume reduction. The recesses formed in the front and rear sheets, which are harder than the right and lefts sheets, allow a person to easily, surely hold the toner container.

Because the angle of inclination is larger than 45° when the toner container is packed with toner, the toner container can be folded up in a compact configuration when the front and rear sheets are pressed.

A substantially hermetic path is established between the toner container and sucking means for sucking toner out of the toner container, so that the volume of the container can automatically reduced by the suction of the sucking means in substantially the same configuration at all times.

While the illustrative embodiments have concentrated on a toner container storing toner as powder, they are, of course, similarly applicable to any other powder, e.g., a toner and carrier mixture or two-component type developer.

What is claimed is:

1. A powder container, comprising:

a powder storing body storing powder and formed with an opening at one end;

an upper member affixed to said opening of said powder storing body; and an outlet member, which is formed with a passage configured to deliver the powder from said powder storing body to an outlet of the powder container and has a shutter for selectively blocking or unblocking said passage of said outlet member, said outlet member being selectively connectable to said upper member, wherein said shutter is a cylindrical member traversing the passage of said outlet member and is fittable in a transverse cylindrical shutter hole of said outlet member which is substantially transverse to the passage, wherein the cylindrical member traversing the passage of said outlet member has an axis along a length of the cylindrical member which is parallel to an axis of the transverse cylindrical shutter hole.

2. The powder container as claimed in claim 1, wherein the upper member includes a passage between the powder storing body and the passage of the outlet member, an opening area of said passage of said upper member decreases from said opening of said powder storing body toward said outlet member.

3. The powder container as claimed in claim 1, wherein said upper member is rectangular and includes a pair of side surfaces, which face each other, substantially parallel to a front and a rear surface of said powder storing body, and a width between a right and a left surface of said powder storing body is smaller than a width between said pair of side surfaces of said upper member.

4. The powder container as claimed in claim 1, wherein said powder storing body is formed of a flexible material.

5. The powder container as claimed in claim 4, wherein said powder storing body comprises sheets constituting side surfaces when said upper member is positioned at a bottom, and a sheet member constituting a top, and said sheets each are formed of a fold foldable inward.

6. The powder container as claimed in claim 4, wherein said powder storing body comprises sheets constituting side surfaces when said upper member is positioned at a bottom, and a sheet member constituting a top, at least inner surfaces of said sheets, constituting the side surfaces and adjacent to said upper member, are inclined toward said upper member little by little, and an angle between each of the inner surfaces and a horizontal plane is greater than an angle of repose of the powder when said powder is packed in said powder storing body.

7. A powder container according to claim 1, wherein:

the shutter is removably fittable in the shutter hole.

8. The powder container as claimed in claim 1, further comprising:

a protrusion on one of the outlet member and the upper member; and a groove which engages with the protrusion on the other of the outlet member and the base member in order to secure the outlet member to the upper member.

9. The powder container as claimed in claim 1, further comprising:

a first protrusion and first groove which are a first pair, and a second protrusion and a second groove which are a second pair, the first and second pairs being disposed on opposite sides of the outlet and securing the outlet member to the upper member.

10. The powder container as claimed in claim 1, wherein:

the outlet member and the upper member are removably provided from each other.

11. A toner cartridge comprising:

a toner storing body formed with an open portion at one end;

a toner stored in said toner storing body;

an outlet configured to discharge the toner from said toner cartridge;

an outlet member formed with a passage configured to deliver the toner from said toner storing body to the outlet and having a shutter for selectively blocking or unblocking said passage; and an upper member affixed to said open portion of said toner storing body and configured to be selectively connected to or disconnected from said outlet member, wherein said shutter is a cylindrical member traversing the passage of said outlet member and is fittable in a transverse cylindrical shutter hole of said outlet member which is substantially transverse to the passage, wherein the cylindrical member traversing the passage of said outlet member has an axis along a length of the cylindrical member which is parallel to an axis of the transverse cylindrical shutter hole.

12. The toner cartridge of claim 11, wherein:
the shutter is removably fittable in the shutter hole.

13. The toner cartridge as claimed in claim 11, further comprising:
a protrusion on one of the outlet member and the upper member; and
a groove which engages with the protrusion on the other of the outlet member and the base member in order to secure the outlet member to the upper member.

14. The toner cartridge as claimed in claim 11, further comprising:
a first protrusion and first groove which are a first pair, and a second protrusion and a second groove which are a second pair, the first and second pairs being disposed on opposite sides of the outlet and securing the outlet member to the upper member.

15. A refillable toner cartridge comprising:
a toner storing body formed with an open portion at one end;
a refilled toner refilled in said toner storing body when said toner storing body is emptied at least one time;
an outlet configured to discharge the refilled toner from said toner cartridge;
an outlet member formed with a passage configured to deliver the refilled toner from said toner storing body to the outlet and having a shutter for selectively blocking or unblocking said passage; and
an upper member affixed to said open portion of said toner storing body and configured to be selectively connected to or disconnected from said outlet member,
wherein said shutter is a cylindrical member traversing the passage of said outlet member and is fittable in a transverse cylindrical shutter hole, of said outlet member which is substantially transverse to the passage, wherein the cylindrical member traversing the passage of said outlet member has an axis along a length of the cylindrical member which is parallel to an axis of the transverse cylindrical shutter hole.

16. The toner cartridge according to claim 15 wherein:
the shutter is removably fittable in the shutter hole.

17. The refillable toner cartridge as claimed in claim 15, further comprising:
a protrusion on one of the outlet member and the base member; and
a groove which engages with the protrusion on the other of the outlet member and the upper member in order to secure the outlet member to the upper member.

18. The refillable toner cartridge as claimed in claim 15, further comprising:
a first protrusion and first groove which are a first pair, and a second protrusion and a second groove which are a second pair, the first and second pairs being disposed on opposite sides of the outlet and securing the outlet member to the upper member.

19. A powder container, comprising:
a powder storing body configured to store powder and formed with an opening at one end;
an upper member affixed to said opening of said powder storing body; and
an outlet member, which is formed with a passage configured to deliver the powder from said powder storing body to an outlet of the powder container and has a shutter for selectively blocking or unblocking said passage, selectively connectable to said upper member,
wherein said shutter is a cylindrical member traversing the passage of said outlet member and is fittable in a transverse cylindrical shutter hole of said outlet member which transverse cylindrical shutter hole is substantially transverse to the passage, wherein the cylindrical member traversing the passage of said outlet member has an axis along a length of the cylindrical member which is parallel to an axis of the transverse cylindrical shutter hole.

20. The powder container as claimed in claim 19, wherein said powder storing body is formed of a flexible material.

21. The powder container according to claim 19, wherein:
the shutter is removably fittable in the shutter hole.

22. The powder container as claimed in claim 19, further comprising:
a protrusion on one of the outlet member and the base member; and
a groove which engages with the protrusion on the other of the outlet member and the base member in order to secure the outlet member to the upper member.

23. The powder container as claimed in claim 19, further comprising:
a first protrusion and first groove which are a first pair, and a second protrusion and a second groove which are a second pair, the first and second pairs being disposed on opposite sides of the outlet and securing the outlet member to the upper member.

24. A powder container, comprising:
a powder storing body storing powder and formed with an opening at one end;
an upper member affixed to said opening of said powder storing body; and
an outlet member, which is formed with a passage configured to deliver the powder from said powder storing body to an outlet of the powder container and has a shutter for selectively blocking or unblocking said passage, selectively connectable to said upper member,
wherein said shutter is a cylindrical member traversing the passage of said outlet member and is fittable in a transverse cylindrical shutter hole of said outlet member which is substantially transverse to the passage, wherein the cylindrical member traversing the passage of said outlet member has an axis along a length of the cylindrical member which is parallel to an axis of the transverse cylindrical shutter hole,
wherein said outlet member comprises a first part selectively connectable to said upper member and a second part fitted in the first part and including the shutter.

25. The powder container according to claim 24, wherein:
the shutter is removably fittable in the shutter hole.

26. The powder container as claimed in claim 24, further comprising:
a protrusion on one of the outlet member and the base member; and
a groove which engages with the protrusion on the other of the outlet member and the upper member in order to secure the outlet member to the upper member.

27. The powder container as claimed in claim 24, further comprising:
a first protrusion and first groove which are a first pair, and a second protrusion and a second groove which are a second pair, the first and second pairs being disposed on opposite sides of the outlet and securing the outlet member to the upper member.

28. A powder container, comprising:
a powder storing body for storing powder; and
an outlet member, which is formed with a passage configured to deliver the powder from said powder storing body to an outlet of the powder container and has a shutter for selectively blocking or unblocking said passage of said outlet member, wherein said shutter is a cylindrical member traversing the passage of said outlet member and is fittable in a transverse cylindrical shutter hole of said outlet member which is substantially transverse to the passage, wherein the cylindrical member traversing the passage of said outlet member has an axis along a length of the cylindrical member which is parallel to an axis of the transverse cylindrical shutter hole.

29. The powder container as claimed in claim 28, wherein the diameter of the shutter is below 10 mm.

30. The powder container as claimed in claim 28, wherein the shutter is removably fittable in the shutter hole.

31. The powder container as claimed in claim 28, further comprising:

a protrusion on one of the outlet member and an upper member; and a groove which engages with the protrusion on the other of the outlet member and the upper member in order to secure the outlet member to the upper member.

32. The powder container as claimed in claim 28, further comprising:

a first protrusion and first groove which are a first pair, and a second protrusion and a second groove which are a second pair, the first and second pairs being disposed on opposite sides of the outlet and securing the outlet member to an upper member.

* * * * *